United States Patent [19]

Yamaguchi

[11] Patent Number: 4,652,235

[45] Date of Patent: Mar. 24, 1987

[54] BURNING WICK FOR OIL BURNING APPARATUS

[75] Inventor: Isaburo Yamaguchi, Nigata, Japan

[73] Assignee: Kitate Sangyo Co., Ltd., Joetsu, Japan

[21] Appl. No.: 758,980

[22] Filed: Jul. 25, 1985

[30] Foreign Application Priority Data

Apr. 22, 1985 [JP] Japan ..... 60-84611

[51] Int. Cl.[4] ..... F23D 3/18

[52] U.S. Cl. ..... 431/325

[58] Field of Search ..... 431/302–309, 431/325

[56] References Cited

FOREIGN PATENT DOCUMENTS

| | | | |
|---|---|---|---|
| 62901 | 10/1982 | European Pat. Off. | 431/325 |
| 2905 | 1/1982 | Japan | 431/325 |
| 210209 | 12/1982 | Japan | 431/325 |

*Primary Examiner*—Carroll B. Dority, Jr.

*Attorney, Agent, or Firm*—Young & Thompson

[57] ABSTRACT

A tubular burning wick for oil burning apparatus with a stitchless abutment seam, which has either a structure in which a band of wick cloth having at least one burner part (2) made of heat resistant fiber yarn and an oil sucking part (3) made of an oil-soakable yarn is cut to a predetermined length into a band and is looped by abutting both the cut ends thereof to form the tubular burning wick (1), or a structure in which a plurality of tubular segments each comprising a burner part (2) made of heat resistant fiber yarn and an oil sucking part (3) made of oil soakable yarn are preliminarily prepared separately by knitting and the so-knitted tubular segments are put together to let the rims of both the tubular segments abut with each other to form the tubular burning wick. Two reinforcement strips (7,8) are bonded to the outer face of each tubular wick diametrically opposing each other so as to leave two uncovered portions (9,10) on the outer face between the respective ends of the strips. At least one of the reinforcement strips (7,8) is superimposed on the abutment seam of the tubular wick.

10 Claims, 21 Drawing Figures

BURNING WICK FOR OIL BURNING APPARATUS

BACKGROUND OF THE INVENTION

The present invention relates to an oil burning apparatus, such as an oil stove etc., in which the burner part of the burning wick thereof is made to protrude for burning and to recede for extinguishing. More particularly, the invention relates to a tubular burning wick which can be prepared without necessitating laborious stitching of the abutting ends to each other so as to preserve its undistorted cylindrical form during use.

A burning wick for oil burning apparatus such as an oil stove etc., in which the wick has a tubular form, is mounted on a cylindrical wick holder and is raised or lowered for burning or extinguishing, respectively, by manipulating a pinion shaft so as to advance or retract the burner part of the burning wick, is known in various structures.

Burning wicks having a burner part and an oil sucking part or having a burner part, an oil sucking part and a stretchable part are known, for example, from Unexamined Japanese Patent Applications Nos. 17038/1976 and 44325/1976 and Unexamined Japanese Utility Model Application No. 157535/1977.

In these burning wicks, a stitching procedure, namely a machine stitching, is inevitable during the production process thereof.

Thus, in one embodiment of the production of a burning wick, starting wick cloth having a burner part and oil sucking part is knitted into a continuous band on a knitting machine. This band of wick cloth is then cut to a predetermined length by a cutter and is looped to form a tube by putting together both the cut ends, whereupon the overlapped ends are stitched together along the junction seam in zig-zag form.

In another embodiment of the production of a burning wick, a tubular cloth for the burner part and a tubular cloth for the oil sucking part of the burning wick are each knitted separately on a knitting machine and both the tubes thus knitted are then placed in axial alignment so that the rims or peripheral edges of the tubes are joined together, whereupon both rims are stitched together along the joining seam to form a tubular burning wick.

As indicated above, it has been impossible to avoid a stitching procedure in either of the cases mentioned above, either in the axial or circumferential direction along the junction line, in order to obtain tubular burning wick, thus rendering the investment cost higher due to installation of the stitching machine, not to mention the difficulty in the stitching work itself due to the high yieldability of the wick material. It was also and inconvenience that mechanical strengths against tension and torsion at the junction were very low due to occurrence of a sparce zone in the junction caused by the simple zig-zag stitching, occasionally resulting in a failure in the movement of the wick due to a deformation of the junction portion after repeated up-and-down operations of the wick.

While the starting wick cloth may efficiently be made by knitting simultaneously the burning part made of heat-resistant fiber yarn (e.g. glass fiber) and the oil sucking part made of oil-soakable yarn (e.g. cotton, staple fiber, etc.) on an automatic knitting machine, it is necessary to prepare a tubular product therefrom by cutting it into a band and looping the band by abutting the cut ends. This has been done by stitching the abutment seam together in zig-zag form on a stitching machine one-by-one by hand and is thus accompanied by a low productivity and a great deal of manpower.

BRIEF SUMMARY OF THE INVENTION

The object of the present invention is a novel tubular burning wick which can be produced in an economical and efficient manner and which eliminates the need for laborious stitching work while producing a wick which retains its steady cylindrical configuration during the use thereof.

Another object of the invention is a novel tubular burning wick prepared without necessitating stitching work, which has an increased mechanical strength against tension and torsion either in the portion of the junction between the overlapping ends of a band of wick cloth having at least a burner part and an oil sucking part or in the portion of the junction between the overlapping circumferential edges or rims of at least a tubular burner part and a tubular oil sucking part thereof.

The above objects and others are attained by a novel tubular burning wick according to the present invention which eliminates the need for stitching together the abutment seam, which has either a structure in which a band of wick cloth having at least one burner part made of heat resistant fiber yarn and at least one oil sucking part made of oil soakable yarn is cut in a predetermined length into a band and is looped by abutting both the cut ends thereof to form said tubular burning wick, or a structure in which a plurality of tubular segments for at least a burner part made of heat-resistant fiber yarn and an oil sucking part made of oil soakable yarn are initially separately prepared by knitting and the so-knitted tubular segments are put together so that the rims of both the tubular segments abut each other to form said tubular burning wick; characterized in that two reinforcement strips are bonded to the outer face of the tubular wick, opposing diametrally each other so as to leave two uncovered portions on said outer face between the respective ends of the strips, wherein at least one of said reinforcement strips is superimposed on the abutment seam of the tubular wick.

BRIEF DESCRIPTION OF THE DRAWINGS

The above and other object and features of the present invention will become more apparent with reference to the accompanying drawings in which.

DETAILED DESCRIPTION OF THE INVENTION

Figure 1:
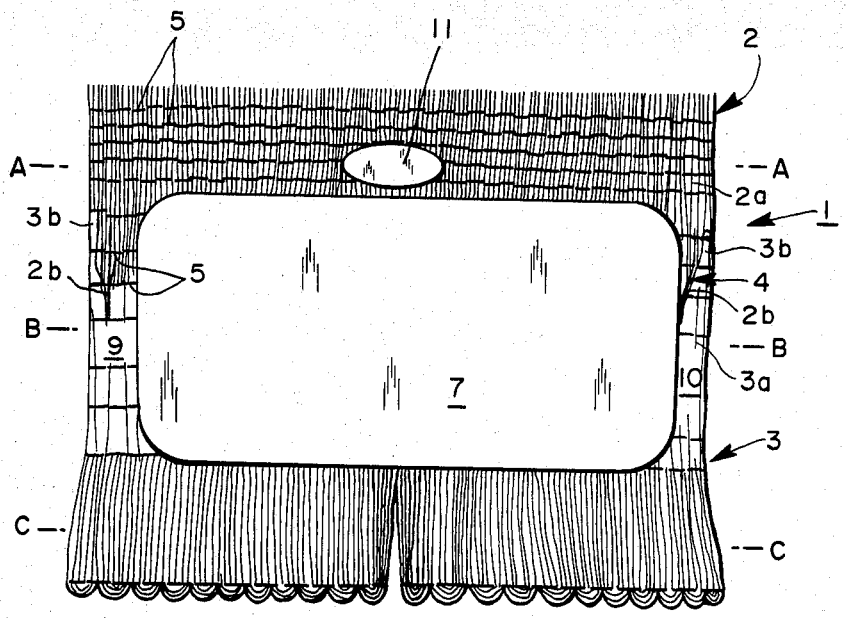
FIG. 1 is a front view showing a first embodiment of the burning wick of the present invention.

The invention will be explained specifically hereinafter with reference to the accompanying drawings showing several non-limiting examples.

EXAMPLE 1

In FIGS. 1 to 6, the first embodiment of the burning wick according to the present invention is shown. The burning wick 1 has a burner part 2 and an oil sucking part 3 which are combined integrally. The burner part 2 is made of heat-resistant fiber yarn 2*a*, such as glass fiber, etc. The oil sucking part 3 consists of yarn 3*a* of oil soakable fiber, such as cotton, staple fiber, etc. The burner part 2 and the oil sucking part 3 are knitted simultaneously on an automatic knitting machine. Thus, cloth for a burning wick composed of two distinct but combined sections 2 and 3 of different kinds of yarn 2*a* and 3*a* is knitted on the machine continuously in the form of an endless band. At the junction portion 4 between the burner part 2 and the oil sucking part 3, the return ends 2*b* and 3*b* of the yarns 2*a* and 3*a* intermix one into another. The intermix section is knitted by warps.

The band thus obtained is then cut in the direction lateral to the longitudinal direction thereof to a predetermined length. On the terminal face of the cut end of the so-prepared starting wick cloth is applied a fast-drying adhesive and the wick cloth is looped by abutting both the cut ends to form a tube having a temporary bound seam. Superimposed on the bound seam, an oblong reinforcement strip 7 is attached on the outer face of the wick cloth with an adhesive. The reinforcement strip may consist of, for example, a sheet of synthetic resin, paper treated by a reinforcement processing, woven cloth, or metal foil, such as aluminum foil, etc., and similar sheet metals. The reinforcement strip can be perforated in order to facilitate handling. The binding reinforcement strip 7 extends over the wick cloth from a position slightly offset from the upper edge of the burner part 2 to a position slightly off-set from the bottom edge of the oil sucking part. The strip 7 extends in the circumferential direction on the tubular wick 1 covering almost the entire half of the circumference (see FIG. 1).

Figure 2:
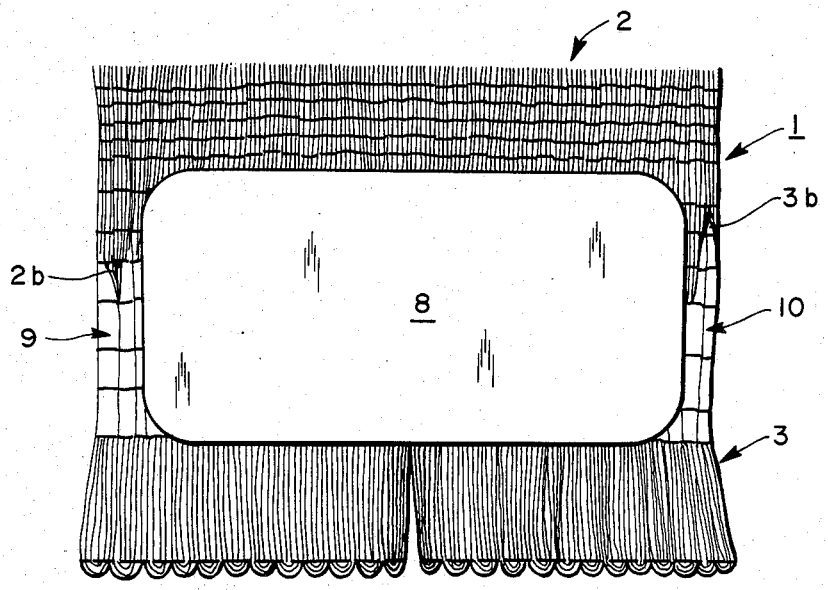
FIG. 2 is a rear view.
Figure 3:
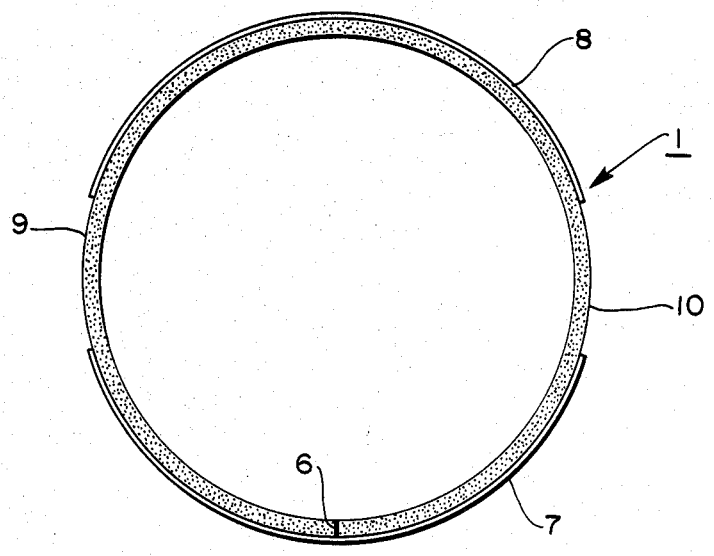
FIG. 3 is a plan view.
Figure 4:
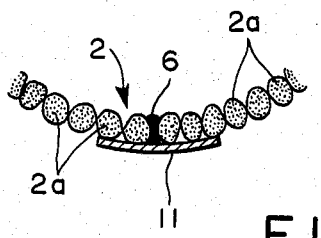
FIG. 4 is a partial section cutaway through line A—A of FIG. 1
Figure 5:
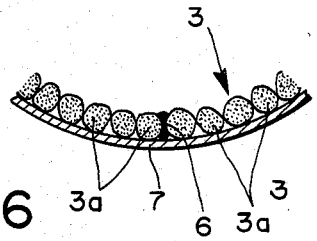
FIG. 5 is a partial section cutaway through line B—B of FIG. 1.
Figure 6:
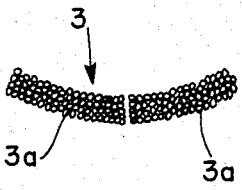
FIG. 6 is a partial section cutaway through line C—C of FIG. 1.

Opposing diametrally the reinforcement strip 7, another reinforcement strip 8 is attached to the outer face of the tubular wick 1, using an adhesive, as well as about the connection region 4 between the burner part 2 and the oil sucking part 3 thereof over almost the entire half of the circumference of the tube (see FIG. 2). Both the reinforcement strips 7 and 8 preferably have the same oblong configuration and are made of the same material. These reinforcement strips 7 and 8 contribute for fixing the wick within the burning wick holder (not shown), by being held by the claws arranged on the wick holder when the wick is mounted on the holder.

The interstices between the ends of the reinforcement strip 7 and the corresponding ends of the reinforcement strip 8 are left uncovered so as to leave two free surface regions 9 and 10. The tubular burning wicks are folded at these uncovered regions 9, 10 and piled one over another for transportation, etc.

On the outer face of the burner part 2, there is fixed, also with an adhesive, a supplemental binding member 11 (see FIG. 1). The supplemental binding member 11 preferably consists of the same material as the reinforcement strips mentioned above. The supplemental binding member 11 for the burner part 2 may have a configuration of, for example, an ellipse, and is bonded to the outer face of the burner part 2 and superposed on the abutment seam 6 thereof, in order to hold the abutment ends against disconnection thereof. Thus, the abutment seam 6 of the tubular burning wick can be held firmly combined, without separation, under the aid of the reinforcement strip 7 and the supplemental binding member 11 on the burner part 2.

As described above, in the tubular burning wick composed in accordance with the present invention, the stitching of a seam between the abutting cut ends of the wick cloth is dispensed with. The cut ends of the wick cloth are bound together only by putting them together with the use of an adhesively bound reinforcing member to form a tube of wick cloth, so that installation of a stitching machine which has hitherto been indispensable now becomes unnecessary. Thus, the binding of the abutting ends does not require a stitching work and can be achieved simply by putting them together, so that the work is very simple and is achieved efficiently. The tubular burning wick according to the present invention is foldable at the interstitial regions 9 and 10 between the ends of the reinforcement strips, as these portions are left uncovered, in order to facilitate the transportation etc. thereof and to avoid an occurrence of undesirable fold creases in the wick.

EXAMPLE 2

In FIGS. 7 to 12, a second embodiment of the present invention is shown. The burning wick 1A of this example is composed of a burner part 2, an oil sucking part 3 and a stretchable part 17. The reinforcement strip 7A attached to the burning wick superposed on the junction seam between the burner part 2 and the oil sucking part 3 is similar to the reinforcement strip 7 in Example 1. The reinforcement strip 7A has, integrally therewith, a supplemental binding member 12 for the burner part.

Figure 7:
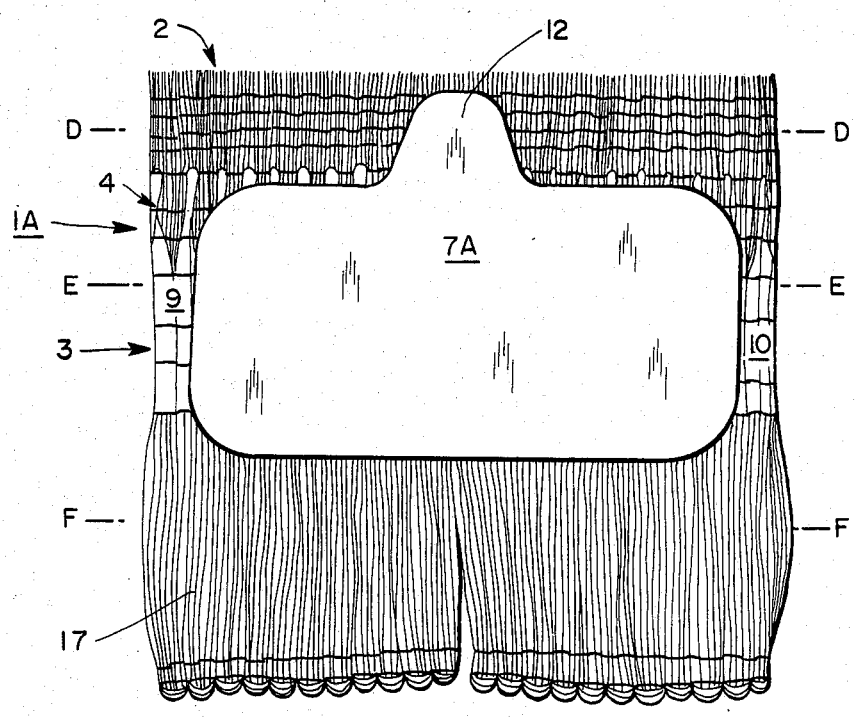
FIG. 7 is a front view showing a second embodiment of the burning wick of the present invention.
Figure 8:
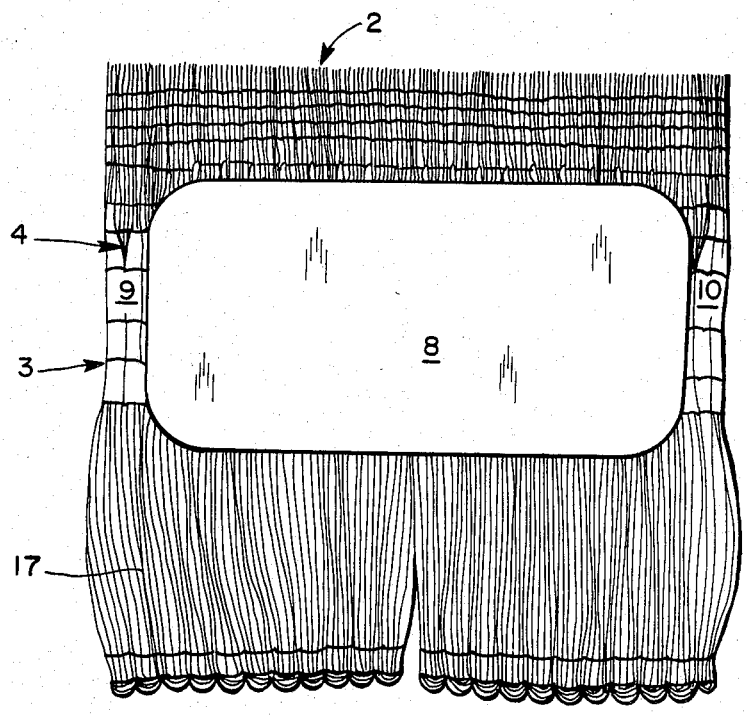
FIG. 8 is a rear view.
Figure 9:
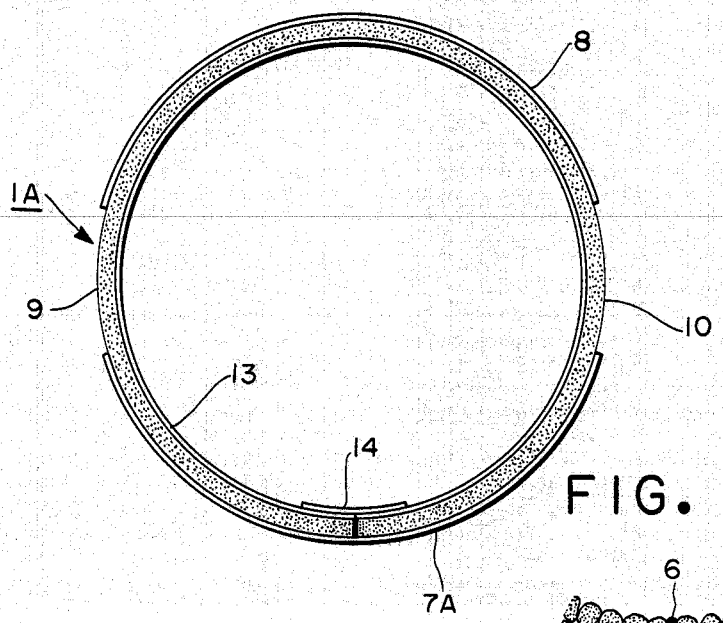
FIG. 9 is a plan view.
Figure 11:
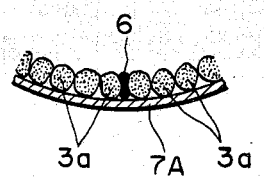
FIG. 11 is a partial section cutaway through line E—E of FIG. 7.
Figure 12:
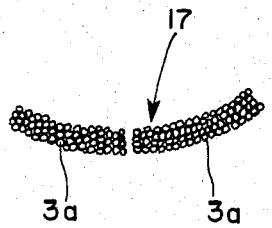
FIG. 12 is a partial section cutaway through line F—F of FIG. 7.
Figure 10:
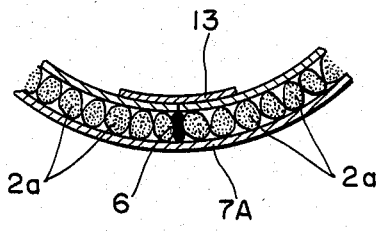
FIG. 10 is a partial section cutaway through line D—D of FIG. 7.
Figure 13:
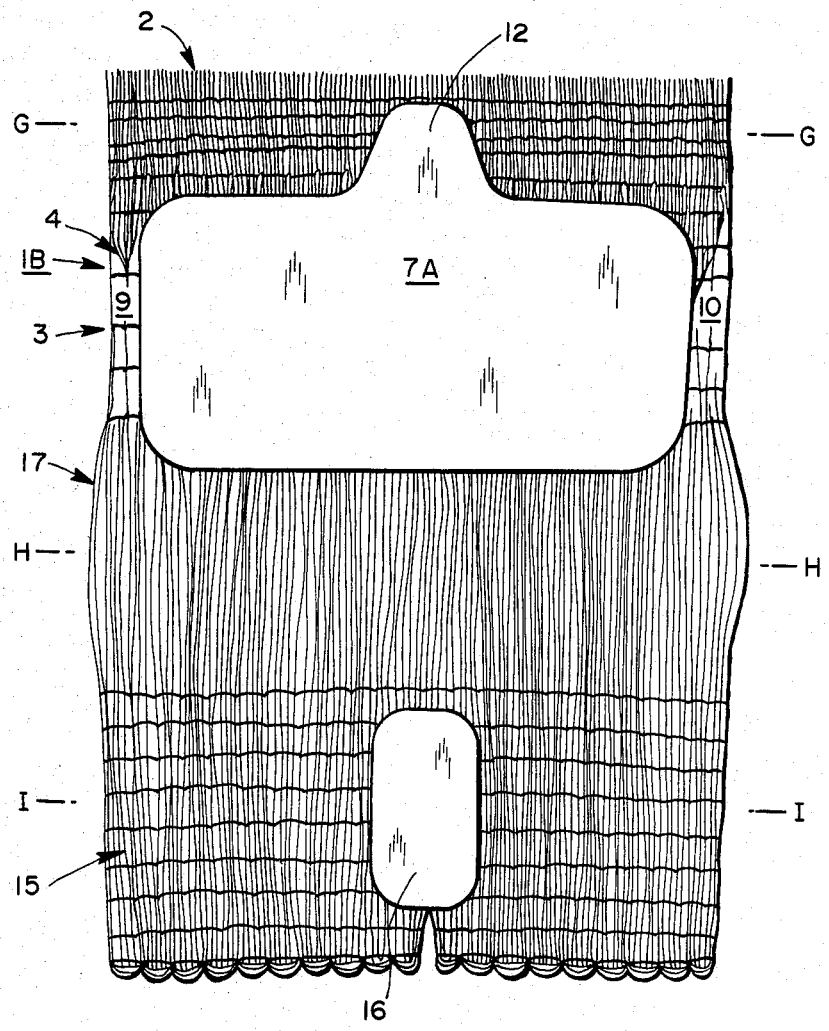
FIG. 13 is a front view showing a third embodiment of the burning wick of the present invention.
Figure 14:
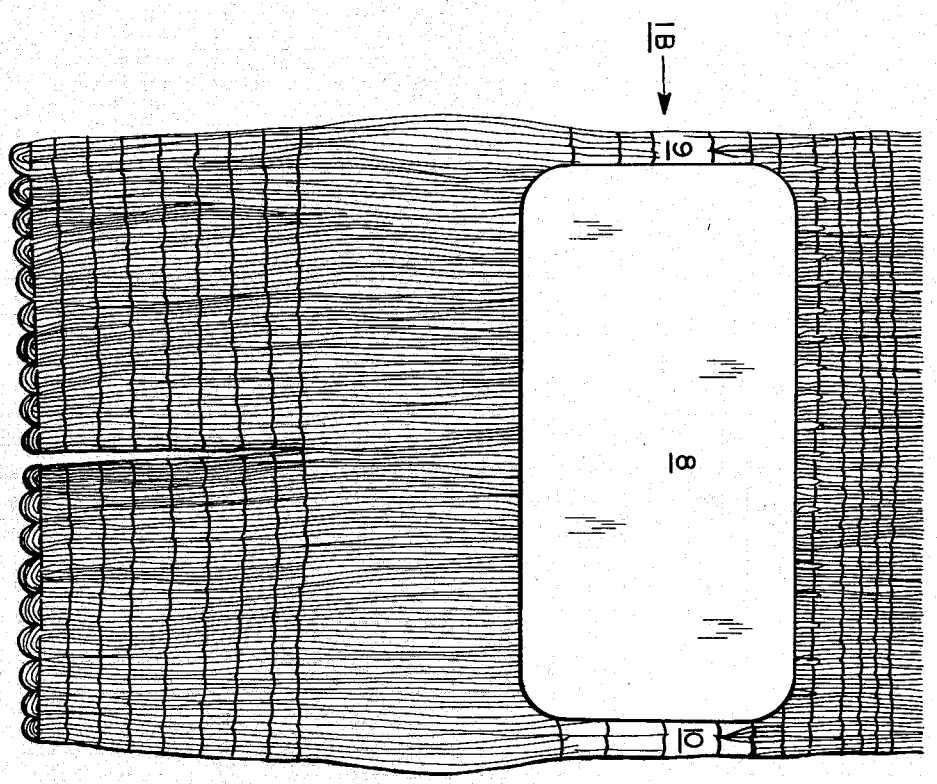
FIG. 14 is a rear view.
Figure 15:
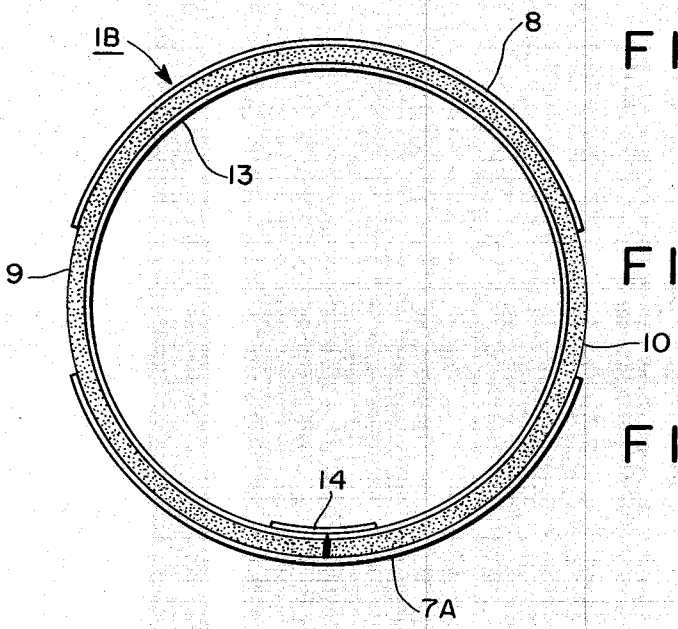
FIG. 15 is a plan view.
Figure 16:
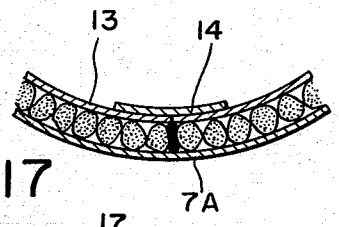
FIG. 16 is a partial section cutaway through line G—G of FIG. 13.
Figure 17:
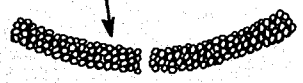
FIG. 17 is a partial section cutaway through line H—H of FIG. 13.
Figure 18:
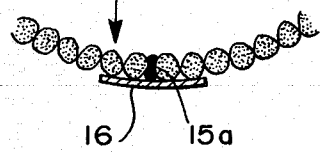
FIG. 18 is a partial section cutaway through line I—I of FIG. 13.

Thus, the supplemental binding member 12 is arranged in the reinforcement strip 7A at the central portion to project outwardly (see FIG. 7). The reinforcement strip 7A of this example has the advantage that the supplemental binding member 12 will be properly positioned when this reinforcement strip 7A is applied onto the outside of the tubular burning wick superposed on the abutment seam 6. Thus, using the reinforcement strip of this example, a separate application of the supplemental binding member 12 is dispensed with.

Opposing diametrally the reinforcement strip 7A is another reinforcement strip 8 fixed on the outer face of the tubular wick in a similar manner as in Example 1. The two portions between the corresponding ends of the reinforcement strips 7A and 8 are left as free surface regions 9 and 10. In this example, an inside reinforcement sheet 13 is fixed to the inner face of the tubular wick in the burner part 2. The inside reinforcement sheet 13 is so applied on the inner face of the tubular wick that both cut ends of the sheet join together at the abutment seam 6 of the burner part. Superposed on the junction seam of the reinforcement sheet 13, there is applied with an adhesive a binder leaf 14. The binder leaf 14 preferably consists of the same material as that of the reinforcement strips. The reinforcement sheet has been applied on the one side of the starting band of wick cloth by an automatic application unit (not shown) before it is cut and looped into a tubular wick. The starting rolled strip for the inside reinforcement sheet is provided with scheduled cutting lines of a predetermined interval for defining a precise cutting of the starting band of wick cloth. Thus, by cutting the band of wick cloth at each cutting line indicated on the strip of inside reinforcement sheet, a precise cutting of the band will be attained in a simple manner.

By the use of the inside reinforcement sheet 13, the stiffness of the burner part 2 is increased, so that deformation of the burner part 2 upon touching of the igniter filament to the burner part 2 for firing the wick is prevented, thus offering a better contact of the firing filament of the igniter with the burner part 2 to realize a smooth firing of the wick.

The inside reinforcement sheet and the outer reinforcement strips may be perforated so as to facilitate handling of the burning wick.

EXAMPLE 3

In the embodiment shown in FIGS. 13 to 18, the burning wick 1B consists of burner part 2, an oil sucking part 3, a stretchable part 17 and a support cylinder 15. The manner of binding of the junction seam between the burner part 2 and the oil sucking part 3 is similar to that of Example 2. Here also, an inside reinforcement sheet 13 and a binder leaf 14 fixed on the junction seam thereof are employed. In this embodiment however, another supplemental binding member 16 is adopted to bind the abutment ends of the support cylinder 15 by fixing it on the outer face thereof superposed on the abutment seam 15*a*.

In this embodiment, the burning wick 1B consists of the burner part 2, oil sucking part 3, stretchable part 17 and support cylinder 15, various other combinations being allowable. For example, the stretchable part may be omitted. The outer reinforcement strips, inside reinforcement sheet, supplemental binding members and binder leaf may be made of the same or different materials, while it is preferable to choose the same material for them.

EXAMPLE 4

Figure 19:
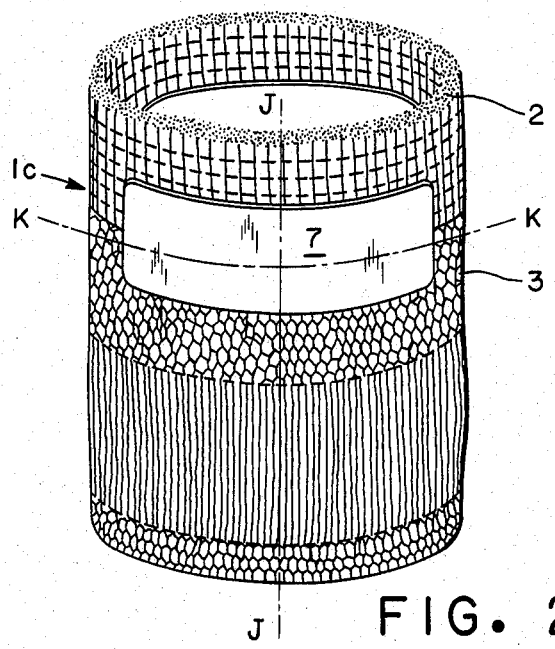
FIG. 19 is a perspective view showing a fourth embodiment of the burning wick of the present invention.
Figure 20:
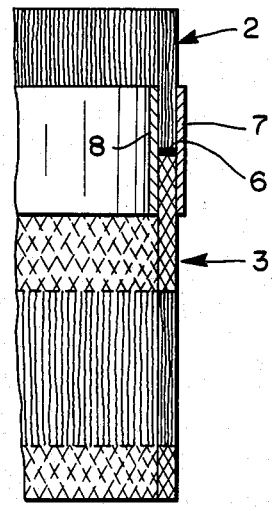
FIG. 20 is a partial section cutaway through line J—J of FIG. 19.
Figure 21:
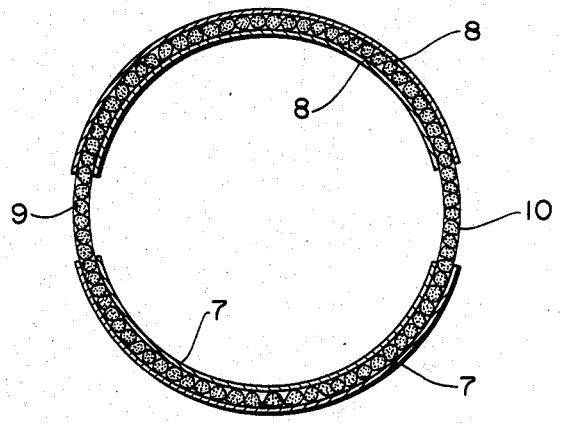
FIG. 21 is a section cutaway through line K—K of FIG. 19.

The burning wick 1C of the embodiment illustrated in FIGS. 19 to 21 is prepared using a cylinder knitting machine. The burner part 2 and the oil sucking part 3 are each knitted separately into a tubular segment. The tubular segments for the burner part 2 and the oil sucking part 3 so knitted are then axially aligned so as to cause the opposing rims or peripheral edges of the tubular segments to abut each other. Superposed on the abutment seam 6, two outer reinforcement strips 7 and 8 are fixed by an adhesive on the outer face of the so-abutted tube, in such a manner that they oppose diametrally each other (see FIG. 21). In this embodiment, two inside reinforcement sheets are employed, as shown in FIG. 21. The reinforcement strips and the reinforcement sheets are made of the same material and are of the same configurations as those of Example 1.

What is claimed is:

1. In a tubular burning wick for oil burning apparatus, of the type having an outer face and comprising at least one upper annular burner part made of heat resistant fiber yarn and at least one lower annular oil suction part made of oil-soakable yarn; the improvement comprising: a stitchless abutment seam and two reinforced strips bonded to the said outer face of the burning wick diametrally opposing each other and circumferentially spaced apart so as to leave two uncovered portions on said outer face between the respective ends of the strips, at least one of the said two reinforcement strips being superimposed on said stitchless abutment seam of the tubular wick, whereby said abutment seam is held together solely by said at least one of said two reinforcement strips, said two reinforcement strips serving to preserve a cylindrical shape of the tubular wick in use, and said two uncovered portions allowing the wick to be flattened for storage and transportation without creasing said strips.

2. Tubular burning wick according to claim 1, wherein said stitchless abutment seam extends circumferentially about the wick and defines a boundary between said upper annular burner part and said lower annular oil suction part.

3. Tubular burning wick according to claim 1, wherein said stitchless abutment seam extend longitudinally along said outer face of said wick.

4. Tubular burning wick according to claim 1, wherein said reinforcement strips comprise synthetic resin sheets bonded with an adhesive to the wick.

5. Tubular burning wick according to claim 3, and a supplemental binding member for binding said abutment seam, said supplemental binding member being bonded to the outer face of the tubular wick so as to be superimposed on said abutment seam in the burner part.

6. A tubular burning wick according to claim 5, wherein said supplemental binding member for binding the burner part is formed integrally with one of the reinforcement strips at the radially central portion thereof so as to project axially from the upper edge thereof.

7. A tubular burning wick according to claim 1, wherein the tubular burning wick is provided with at least one reinforcement sheet bonded to the inner face thereof in the burner part.

8. Tubular burning wick according to claim 1, wherein said reinforcement strips are paper.

9. Tubular burning wick according to claim 1, wherein said reinforcement strips are cloth.

10. Tubular burning wick according to claim 1, wherein said reinforcement strips are metal foil.

* * * * *